US009656457B2

(12) United States Patent
Becker

(10) Patent No.: US 9,656,457 B2
(45) Date of Patent: May 23, 2017

(54) METHOD FOR CLEANING A PRINT-RELATED SURFACE

(71) Applicant: manroland web systems GmbH, Augsburg (DE)

(72) Inventor: Dorothea Becker, Haigerloch (DE)

(73) Assignee: manroland web systems GmbH, Augsburg (DE)

( * ) Notice: Subject to any disclaimer, the term of this patent is extended or adjusted under 35 U.S.C. 154(b) by 0 days.

(21) Appl. No.: 14/851,507

(22) Filed: Sep. 11, 2015

(65) Prior Publication Data

US 2016/0075129 A1 Mar. 17, 2016

(30) Foreign Application Priority Data

Sep. 12, 2014 (DE) ..... 10 2014 113 217

(51) Int. Cl.

| | |
|---|---|
| ***B41F 35/00*** | (2006.01) |
| ***B41F 35/06*** | (2006.01) |
| ***B41L 41/06*** | (2006.01) |
| ***B08B 1/00*** | (2006.01) |
| ***B08B 3/08*** | (2006.01) |

(Continued)

(52) U.S. Cl.

CPC ..... *B41F 35/06* (2013.01); *B08B 1/002* (2013.01); *B08B 3/08* (2013.01); *B08B 3/10* (2013.01); *B41L 41/06* (2013.01); *C11D 11/0041* (2013.01); *B41P 2235/23* (2013.01); *B41P 2235/24* (2013.01); *B41P 2235/50* (2013.01)

(58) Field of Classification Search

CPC ..... B41P 2235/23; B41F 35/00

USPC ..... 101/425

See application file for complete search history.

(56) References Cited

U.S. PATENT DOCUMENTS

| | | | | |
|---|---|---|---|---|
| 3,309,993 A | | 3/1967 | Grembecki et al. | |
| 3,468,248 A | * | 9/1969 | Giori ..... | B41F 9/1018 101/167 |

(Continued)

FOREIGN PATENT DOCUMENTS

| | | |
|---|---|---|
| DE | 3401159 A1 | 8/1984 |
| DE | 3607908 A1 | 9/1986 |

(Continued)

OTHER PUBLICATIONS

German Patent and Trademark Office, Search Report, German Patent Application No. DE 10 2014 113 217.3, issued May 2, 2015, 9 pages [German language and English language translation].

(Continued)

*Primary Examiner* — Anthony Nguyen

(74) *Attorney, Agent, or Firm* — Christopher C. Dremann, P.C.; Christopher C. Dremann

(57) ABSTRACT

A method for cleaning a rotating surface of a printing press cylinder or a rotating surface of a printing press roller, or a rotating surface of a print form or a transfer form arranged on a printing press cylinder within a printing unit includes the steps of: applying a liquid, water-based washing agent, containing at least 60% water and the rest at least surfactants, onto the surface to be cleaned within the printing unit; dissolving contaminations from the surface to be cleaned within the printing unit with the help of the washing agent and a cleaning device; and removing the dissolved contaminations from the surface to be cleaned within the printing unit, at least with the help of the cleaning device.

19 Claims, 1 Drawing Sheet

(51) Int. Cl.
*B08B 3/10* (2006.01)
*C11D 11/00* (2006.01)

(56) References Cited

U.S. PATENT DOCUMENTS

| | | | | | |
|---|---|---|---|---|---|
| 3,851,965 | A * | 12/1974 | Furuichi | G03G 21/0035 | 15/1.51 |
| 4,015,307 | A | 4/1977 | Kossak | | |
| 4,504,406 | A | 3/1985 | Dhillon | | |
| 5,367,982 | A * | 11/1994 | DeMoore | B41F 31/027 | 101/350.6 |
| 5,515,782 | A * | 5/1996 | Ebina | B41F 35/00 | 101/423 |
| 5,918,545 | A * | 7/1999 | Pym | B41F 35/02 | 101/424 |
| 6,029,575 | A * | 2/2000 | Bischer | B41F 35/06 | 101/424 |
| 6,341,556 | B1 * | 1/2002 | Endo | B41F 9/1018 | 101/155 |
| 6,432,211 | B1 * | 8/2002 | Schmitt | B41N 3/06 | 101/423 |
| 6,576,059 | B2 * | 6/2003 | Burgard | B05C 1/0813 | 118/203 |
| 7,866,260 | B1 * | 1/2011 | Clark | B41F 17/001 | 101/33 |
| 2002/0139268 | A1 * | 10/2002 | Emery | B41F 35/00 | 101/425 |
| 2002/0157205 | A1 * | 10/2002 | Hara | B41F 35/00 | 15/256.52 |
| 2005/0191081 | A1 * | 9/2005 | Muraishi | G03G 15/0225 | 399/100 |
| 2010/0050892 | A1 * | 3/2010 | Balleis | B41F 35/00 | 101/425 |
| 2011/0056039 | A1 * | 3/2011 | Suzuki | B41F 35/00 | 15/210.1 |
| 2012/0103221 | A1 * | 5/2012 | Stowe | B41C 1/1033 | 101/483 |

FOREIGN PATENT DOCUMENTS

| | | | |
|---|---|---|---|
| DE | 19822441 | A1 | 1/1999 |
| DE | 102004022236 | A1 | 12/2005 |
| DE | 202011106154 | U1 | 6/2012 |
| EP | 527315 | A2 | 6/1992 |
| EP | 928687 | A1 | 4/1998 |

OTHER PUBLICATIONS

European Patent Office, Search Report and Written Opinion, European Patent Application No. EP 15182180.8, Issued Feb. 11, 2016, 10 pages [German language].

European Patent Office, Written Opinion—cf Form 1507 Sheet 1—Sheet 4, European Patent Application No. EP 15182180.8, Issued Feb. 11, 2016, 3 pages [English Language Translation].

* cited by examiner

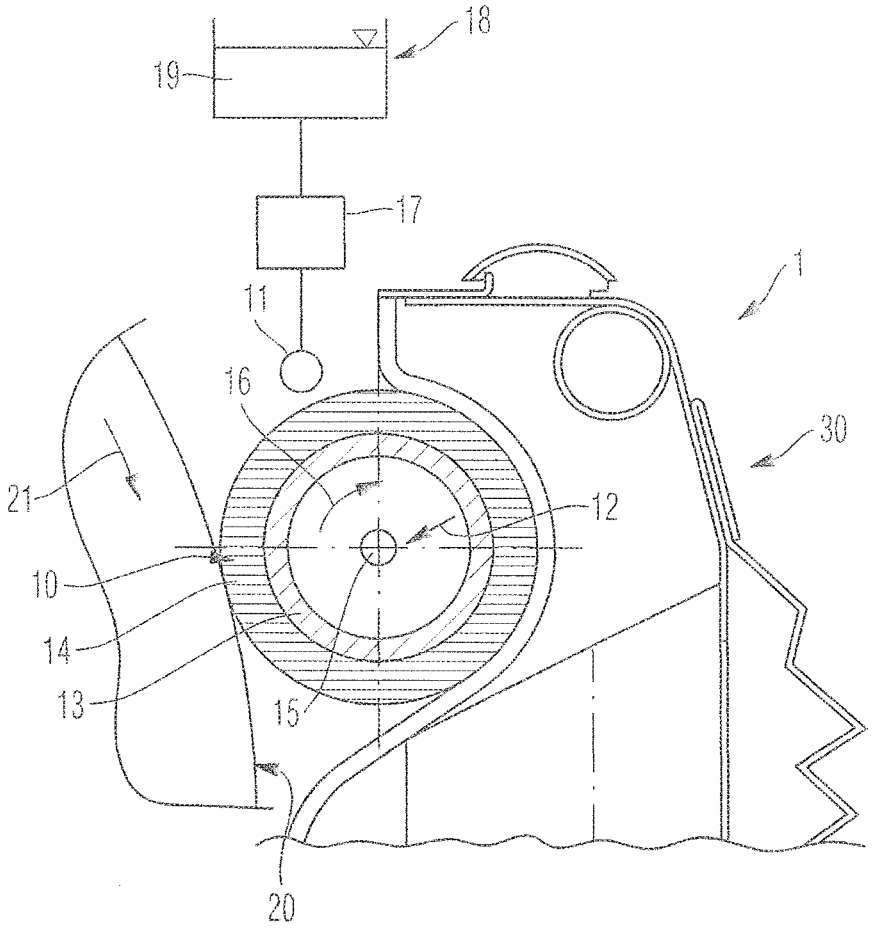
18
19
17
11
16
1
30
21
12
10
14
13
15
20

METHOD FOR CLEANING A PRINT-RELATED SURFACE

CROSS REFERENCE TO RELATED APPLICATION

This United States non-provisional utility patent application claims the benefit of priority to German Patent Application No. 10 2014 113 217.3 filed on Sep. 12, 2014.

FIELD OF THE INVENTION

The invention relates to a method for cleaning a print-related surface.

BACKGROUND OF THE INVENTION AND RELATED ART

Printing units of an offset printing press include a form cylinder, a transfer cylinder, an inking unit, and preferentially, a dampening unit. On the form cylinder of such a printing unit, at least one print form is positioned, which can be designed as a printing plate, which is why form cylinders are also called plate cylinders. On the transfer cylinder of such a printing unit, at least one transfer form is positioned, which can be designed as a blanket and which is why transfer cylinders are also called blanket cylinders. The inking unit of such a printing unit serves for applying printing ink, and the dampening unit of such a printing unit that may be present serves for applying dampening solution onto the or each print form positioned on the form cylinder. Starting out from the or each print form positioned on the form cylinder, the printing ink is transferred onto a substrate to be printed via the or each transfer form positioned on the transfer cylinder, wherein the substrate to be printed is moved through a nip that is positioned between the transfer cylinder and an impression cylinder. The impression cylinder can be a satellite cylinder or also a transfer cylinder of another printing unit. During printing, so-called blanket build-up, which can consist of ink remains and parts of the substrate to be printed can form on the or each transfer form. Such a blanket build-up impairs the achievable print quality and can result in web tears during the printing of a web-like substrate. For this reason it is known from practice to clean the or each transfer form that is positioned on a transfer cylinder before the start of a new print production.

During the printing of particularly high-quality print products, such as for example when printing magazines or catalogues, blanket washing can take place also during the production. In the process, a cleaning device is engaged with a rotating transfer cylinder at full or at reduced production speed and a washing agent is applied onto the transfer cylinder, namely onto the or each transfer form arranged on the transfer cylinder.

From the prior art, a multitude of different cleaning devices for printing presses are known, which serve for cleaning a rotating, cylindrical surface of a printing press cylinder, or a printing press roller, or a surface of a print form or transfer form arranged on a cylinder surface, with which in particular blanket washing can therefore be carried out. Such cleaning devices include a housing, wherein preferentially multiple cleaning devices, namely a washing device and a separate drying device, are accommodated. The washing device serves for washing the respective surface to be cleaned with the help of a liquid washing agent. The drying device serves for drying the cleaned surface.

From U.S. Pat. No. 3,390,993A and from U.S. Pat. No. 4,015,307A, such cleaning apparatuses each with a washing device and a drying device are known, which are accommodated by a housing. Furthermore, it is known that either the washing device or the drying device is engaged with the surface to be cleaned in order to remove and transport away contaminations from the surface to be cleaned in a first cleaning step by way of the washing device, and in order to dry the cleaned surface in a subsequent second cleaning step.

For cleaning a rotating, print-related surface within a printing unit of a printing press, highly solvent-containing liquid washing agents are employed according to practice. Such highly solvent-containing washing agents can on the one hand attack the surface to be cleaned. However, on the other hand the handling of such highly solvent-containing washing agents requires great care because of their health risk potential.

SUMMARY OF THE INVENTION

Starting out from this, the present invention is based on the object of creating a novel and non-obvious method for cleaning a print-related surface. This object is solved through a method for cleaning a print-related surface according to the invention, as shown and described herein. The method according to the invention comprises at least the steps of: applying a liquid, water-based washing agent, which comprises at least 60% water and at least surfactants in the rest, onto the surface to be cleaned within the printing unit, preferentially with the help of a cleaning device that is in contact with the surface to be cleaned; dissolving contaminations from the surface to be cleaned within the printing unit with the help of the washing agent and the cleaning device, which preferentially also serves for applying the washing agent onto the surface to be cleaned; removing the dissolved contaminations from the surface to be cleaned within the printing unit at least with the help of the cleaning device, which preferentially also serves for applying the washing agent.

With the present invention it is proposed for the first time to employ a liquid, water-based washing agent for cleaning a rotating print-related surface within a printing unit, which comprises at least 60% water and in the rest at least surfactants. Such a washing agent on the one hand does not attack the surface to be cleaned and such a water-based washing agent on the other hand does not pose any health hazard and is environmentally safe and compatible.

According to an advantageous further development, a washing agent is applied onto the surface to be cleaned, which comprises at least 80% water and in the rest at least surfactants, wherein the same as surfactants contains exclusively non-ionic surfactants and/or anionic surfactants. The use of a washing agent comprising at least 80% water is particularly preferred in order to exclude a risk to the surfaces to be cleaned and a health hazard for personnel working on the printing press.

According to an advantageous further development, the water-based washing agent is heated to a temperature between 30° C. and 90°, preferably to a temperature between 40° C. and 80°, and most preferably to a temperature between 50° C. and 70°, before applying the washing agent onto the surface to be cleaned. In particular, when the water-based washing agent is heated in this way before being applied onto the surface to be cleaned, particularly effective cleaning of the surface to be cleaned utilising a water-based washing agent can be ensured.

According to an advantageous further development, the water-based washing agent is preferentially sprayed onto the cleaning device serving for applying the washing agent, and with the cleaning device preferentially designed as a cleaning brush, applied onto the surface to be cleaned, wherein the cleaning device at least during the dissolving of the contaminations is pressed against the surface to be cleaned with a defined line pressure force, namely in such a manner that during the cleaning of a transfer form, the same deforms elastically in the region of its surface to be cleaned between 0.01 mm and 0.20 mm. A particularly advantageous cleaning of the surface to be cleaned using a water-based washing agent is thereby possible. In particular, when a transfer form is cleaned with the method according to the invention, the same can be particularly effectively cleaned using a water-based washing agent when the surface of the same is elastically deformed in the stated region.

Preferred further developments of the invention are obtained from the detailed description of exemplary embodiments of the invention provided hereinafter.

BRIEF DESCRIPTION OF THE DRAWING FIGURE

Exemplary embodiments of the invention are explained in more detail hereinafter with the help of the accompanying drawing FIGURE, without being limited thereby in any manner.

The drawing FIGURE shows an extract from a cleaning apparatus for a printing press in the region of a cleaning device with the cleaning device designed as a cleaning brush.

DETAILED DESCRIPTION OF EXEMPLARY EMBODIMENTS

The invention relates to a method for cleaning a print-related surface within a printing unit of a printing press. The method serves for cleaning a rotating, cylindrical surface of a printing press cylinder or a printing press roller to be cleaned, or the cleaning of a surface of a print form or transfer form arranged on a cylinder surface in the region of a printing unit or within a printing unit between printing orders, or also during the production of one and the same printing order. Preferably, the invention is used for cleaning a transfer form positioned on a transfer cylinder, which for example can be designed as a blanket, blanket plate or blanket sleeve.

The drawing FIGURE shows an extract from a cleaning apparatus 1. The cleaning apparatus 1 comprises a housing 30, in which a first cleaning device or washing device 10 preferentially formed as a cleaning brush 10, and preferentially, a separate second cleaning device or drying device (not shown) are accommodated. Such a separate drying device is preferred, but optional.

Alternatively, the cleaning device 10 can also be embodied as a so-called cloth system. With a so-called cloth system, cloth or fleece is employed instead of a cleaning brush. The cleaning cloth is unwound from a cloth reel and formed as a new reel, pressed via a press bar or press beam against the surface 20 to be cleaned, and thus, brought into contact with the same. The cloth portion that is contaminated by the cleaning and/or dry cloth section that is contaminated by the cleaning and/or drying process in this case is rewound onto a so-called dirt reel, for example.

Alternatively, the cleaning cloth can also be used as a cover of a cleaning roller. Here it is immaterial if the cleaning cloth serving as cover has a closed form and is covering an element, which is preferentially embodied as a roller, or whether the cleaning cloth has an open form and on which the press bar or press beam is clamped, so that the same on contacting the surface 20 of a rotating body to be cleaned can withstand the friction forces that occur.

In particular, when the cleaning apparatus 1 comprises the washing device that is preferentially formed as a cleaning brush 10, and furthermore a separate drying device, the same can be preferentially driven originating from a common drive.

In particular, when the cleaning apparatus 1 comprises the washing device formed as a cleaning brush 10, and furthermore a separate drying device, only one of these devices is preferentially engaged with the surface to be cleaned at a time, wherein for ensuring the alternating engagement or disengagement of washing device 10 and drying device with the surface to be cleaned, the housing 30 accommodating these two devices can then be pivoted about a pivot axis.

The cleaning apparatus 1 serves for cleaning a rotating, print-related surface 20 in the region of a printing unit or within the printing unit of a printing press, preferentially between printing orders or during the production of a single printing order. For cleaning the respective surface 20 to be cleaned, a liquid, water-based washing agent 19, which is kept ready in a reservoir 18, can be applied onto the surface 20 to be cleaned. Preferentially, the liquid, water-based washing agent 19 is applied onto the surface 20 to be cleaned with the help of the cleaning device 10 of the cleaning apparatus 1, which is preferentially formed as a cleaning brush 10. The liquid, water-based washing agent 19, with an advantageous configuration thereto, is taken from the reservoir 18 and sprayed onto the cleaning brush 10 with the help of a spraying device 11, which then when rolling on the surface 20 to be cleaned, applies the water-based washing agent 19 onto the rotating surface 20 to be cleaned.

Alternatively or additionally, the liquid, water-based washing agent 19 can also be directly applied onto the surface 20 to be cleaned, for example by direct spraying-on by means of the spraying device 11.

With the help of the water-based washing agent 19 applied onto the surface 20 and preferentially with the help of the cleaning brush 10 rolling on the surface, contaminations can be dissolved from the surface 20 to be cleaned, wherein the dissolved contaminations are removed from the surface 20 to be cleaned at least with the help of the cleaning brush 10.

The water-based washing agent 19 in the process dissolves the contaminations from the surface 20 to be cleaned through adhesion and cohesion effects.

In particular, when the cleaning apparatus 1 comprises the cleaning brush 10, and furthermore a separate drying device, the cleaning brush 10 preferentially serves for applying the liquid, water-based washing agent 19, dissolving the contaminations from the surface 20 to be cleaned, and the partial or complete removing of the dissolved contaminations from the surface 20 to be cleaned. In addition, the drying device then serves for the removing if applicable of the residual contaminations from the surface 20 to be cleaned and at least for the drying of the same.

In particular, when the cleaning apparatus 1, in addition to the cleaning brush 10, does not comprise a separate drying device, the cleaning brush 10 serves for the complete removal of the dissolved contaminations and the subsequent drying of the surface 20 to be cleaned. During the drying of the surface 20 to be cleaned, no further washing agent 19 is applied onto the surface 20 to be cleaned via the cleaning brush 10.

As explained above, the aim of the present invention is to apply a liquid, water-based washing agent 19 onto the print-related, rotating surface 20 to be cleaned within the printing unit, wherein the water-based washing agent 19 comprises at least 60% water, preferably at least 80% water, and the rest at least surfactants. As to the surfactant, the washing agent 19 comprises exclusively non-ionic surfactants and/or anionic surfactants.

Preferably, a water-bashed washing agent 19 is used which comprises at least 80% water, 10% to 19% surfactants and 1% to 10% solvent.

As to the solvent, glycol ether or a polar ester oil can be used, for example.

The ph-value of the washing agent 19 used is preferentially between 7 and 13, more preferably between 8 and 12, and most preferably between 10 and 11.

Preferentially, a water-based washing agent 19 is used which is marketed by the Schwegmann Company under the product designation "SCHWEGO aqua clean", and in particular, the washing agent "SCHWEGO aqua clean CC23".

According to an advantageous further development of the present invention, the liquid washing agent 19 is heated prior to the application on the surface 20 to be cleaned, namely before the same is sprayed onto the cleaning brush 10 via the spraying device 11 and/or prior to being directly sprayed onto the surface 20 to be cleaned, namely with the help of the heating apparatus 17 shown in the drawing FIGURE. In the process, the washing agent 19 is heated to a temperature between 30° C. and 90° C., more preferably to a temperature between 40° C. and 80° C., and most preferably to a temperature between 50° C. and 70° C.

The heated, liquid washing agent 19 is preferentially sprayed onto the cleaning brush 10 with the help of the spraying device 11 with a pressure between about 1 bar and about 5 bar.

During the cleaning of the surface 20 to be cleaned, namely when applying the washing agent 19 onto the surface 20, during the dissolving of the contaminations, and during the removing of the contaminations, it is not only the surface 20 to be cleaned that is rotatingly driven according to the arrow 21, but in addition to this also the cleaning brush 10 is rotated according to the arrow 16. The rotational speed of the cleaning brush 10 is preferentially between about 100 rpm and about 500 rpm. In addition to this rotary movement, the cleaning brush 10 performs an oscillating movement seen in the direction of the longitudinal axis 15, but not necessarily.

The cleaning brush 10 is a brush having a basic body 13 and a bristle facing 14 carried by the basic body 13, wherein the bristles of the bristle facing 14 are preferentially made of plastic and have a thickness between about 0.10 mm and about 0.20 mm. However, other bristles can also be employed.

During the cleaning of the surface 20 to be cleaned, namely at least during the dissolving of the contaminations from the surface 20 to be cleaned, and preferentially also during the application of the liquid, water-based washing agent 19 and during the removing of the dissolved contaminations, the cleaning brush 10 is pressed against the surface 20 to be cleaned with a defined line pressure force 12, namely in such a manner that during the cleaning of a transfer form, the same elastically deforms in the region of its surface to be cleaned between about 0.01 mm and about 0.20 mm. To this end, the cleaning brush 10 is preferentially pressed against the surface 20 of the transfer form to be cleaned with a line pressure force 12 between about 0.5 N/mm and about 10 N/mm. The dimension of the elastic deformation of the transfer form with such a line pressure force 12 also depends on whether the transfer form is a conventional blanket, a metal back blanket or a transfer sleeve.

Using a water-based washing agent 19, surfaces 20 to be cleaned, in particular a surface of a transfer form to be cleaned, can be effectively and carefully cleaned within a printing press, namely within a printing unit. Preferentially, the water-based washing agent 19 in the process is heated before being applied onto the surface 20 to be cleaned, wherein the cleaning brush 10, which serves for applying the washing agent 19 onto the surface 20 to be cleaned, and for dissolving and at least partial removing of contaminations, is pressed against the surface 20 to be cleaned with a defined line pressure force 12.

That which is claimed is:

1. A method for cleaning a surface of a transfer form arranged on a transfer cylinder of a printing press, the method comprising:

applying a liquid, water-based washing agent comprising at least 60% water and the rest at least surfactants onto the surface;

dissolving contaminations comprising ink residue and substrate debris from the surface with the washing agent and a cleaning device; and removing the dissolved contaminations from the surface at least with the cleaning device;

wherein the cleaning device at least during the dissolving of the contaminations is pressed against the surface to be cleaned with a line pressure force such that the surface of a transfer form is elastically deformed between about 0.01 mm and about 0.20 mm.

2. The method according to claim 1, wherein the washing agent comprises at least 80% water and the rest at least surfactants.

3. The method according to claim 1, wherein the washing agent comprises at least 80% water, between 10% and 19% surfactants and between 1% and 10% of a solvent.

4. The method according to claim 1, wherein the surfactants of the washing agent comprise non-ionic surfactants and anionic surfactants.

5. The method according to claim 1, wherein the water-based washing agent is applied with the cleaning device in contact with the surface to be cleaned and rolling on the surface to be cleaned.

6. The method according to claim 1, wherein the washing agent is sprayed onto the cleaning device and is applied onto the surface to be cleaned with the cleaning device being a cleaning brush.

7. The method according to claim 1, wherein the cleaning device presses against the surface to be cleaned of the transfer form with a line pressure force between about 0.5 N/mm and about 10 N/mm.

8. The method according to claim 1, wherein prior to applying the washing agent on the surface to be cleaned, the washing agent is heated to a temperature between about 30° C. and about 90° C.

9. The method according to claim 8, wherein the washing agent is heated to a temperature between about 40° C. and about 80° C.

10. The method according to claim 9, wherein the washing agent is heated to a temperature between about 50° C. and about 70° C.

11. The method according to claim 1, wherein applying the washing agent, dissolving the contaminations and removing the dissolved contaminations is done between a first and a second printing order.

12. The method according to claim 1, wherein applying the washing agent, dissolving the contaminations and removing the dissolved contaminations is done during the production of a printing order.

13. The method according to claim 1, wherein the transfer form is selected from the group comprising a blanket, a blanket plate and a blanket sleeve.

14. A method for cleaning a rotating surface of a transfer form positioned on a transfer cylinder, comprising:

providing a liquid, water-based washing agent and a cleaning device;

heating the washing agent to a preselected temperature;

applying the heated washing agent onto the cleaning device;

pressing the cleaning device against the rotating surface of the transfer form with a line pressure force such that the surface of the transfer form is elastically deformed between about 0.01 mm and about 0.20 mm;

dissolving contaminants comprising ink residue and substrate debris from the rotating surface of the transfer form using the washing agent applied onto the cleaning device; and removing the dissolved contaminants from the rotating surface of the transfer form using the cleaning device.

15. The method according to claim 14, wherein the cleaning device comprises a cleaning brush having a basic body and a bristle facing carried by the basic body.

16. The method according to claim 14, wherein the preselected temperature is between about 30° C. and about 90° C.

17. The method according to claim 16, wherein the preselected temperature is between about 40° C. and about 80° C.

18. The method according to claim 17, wherein the preselected temperature is between about 50° C. and about 70° C.

19. The method according to claim 14, wherein applying the heated washing agent, dissolving the contaminations from the surface of the transfer form and removing the dissolved contaminations from the surface of the transfer form is done during the production of a printing order, and wherein the transfer form is selected from the group consisting of a blanket, a blanket plate and a blanket sleeve.

* * * * *